US009330815B2

(12) United States Patent
Ng et al.

(10) Patent No.: US 9,330,815 B2
(45) Date of Patent: May 3, 2016

(54) CABLE STRUCTURES WITH INSULATING TAPE AND SYSTEMS AND METHODS FOR MAKING THE SAME

(71) Applicant: Apple Inc., Cupertino, CA (US)

(72) Inventors: Nathan Nicholas Ng, Fremont, CA (US); Min Chul Kim, Santa Clara, CA (US)

(73) Assignee: APPLE INC., Cupertino, CA (US)

( * ) Notice: Subject to any disclaimer, the term of this patent is extended or adjusted under 35 U.S.C. 154(b) by 18 days.

(21) Appl. No.: 13/966,956

(22) Filed: Aug. 14, 2013

(65) Prior Publication Data

US 2015/0047873 A1 Feb. 19, 2015

(51) Int. Cl.

| | |
|---|---|
| ***H01B 7/02*** | (2006.01) |
| *H01B 11/12* | (2006.01) |
| *H04R 1/10* | (2006.01) |

(52) U.S. Cl.

CPC ..... *H01B 7/0241* (2013.01); *H01B 11/12* (2013.01); *H04R 1/1016* (2013.01); *H04R 1/1033* (2013.01)

(58) Field of Classification Search

CPC ..... H04R 1/1016; H04R 1/1033; H01B 3/40; H01B 11/12; H01B 11/00; H01B 11/02; H01B 11/085; H01B 11/06; H01B 11/08; H01B 11/1008; H01B 11/1091; H01B 7/0241; H01B 7/02; H01B 7/288; B29K 2105/162; B29K 2105/122; B29D 99/00; B29C 70/521; B29C 70/025; D02G 3/00; G01M 3/165; G01M 3/16; Y10T 29/49117

USPC ..... 174/110 R, 81, 36, 106 R, 107, 350, 174/120 R, 116; 29/825; 73/40, 40.5 R; 340/605; 324/533; 57/210, 3; 264/165

See application file for complete search history.

(56) References Cited

U.S. PATENT DOCUMENTS

| | | | | |
|---|---|---|---|---|
| 1,948,616 | A * | 2/1934 | Fischer | 174/103 |
| 3,138,915 | A * | 6/1964 | Ege | 57/14 |
| 3,622,683 | A * | 11/1971 | Roberts | H01B 11/085 174/103 |
| 4,085,284 | A * | 4/1978 | Olszewski et al. | 174/36 |
| 4,340,771 | A | 7/1982 | Watts | |
| 4,760,362 | A | 7/1988 | Maki | |
| 5,177,996 | A | 1/1993 | Sahakian | |
| 5,530,203 | A * | 6/1996 | Adams et al. | 174/36 |
| 5,635,677 | A | 6/1997 | Wood et al. | |
| 6,506,976 | B1 | 1/2003 | Neveux | |

(Continued)

FOREIGN PATENT DOCUMENTS

| | | |
|---|---|---|
| CN | 101116152 | 1/2008 |
| JP | 2012-533849 | 12/2012 |
| WO | 2011/008568 | 1/2011 |

*Primary Examiner* — Timothy Thompson
*Assistant Examiner* — Guillermo Egoavil
(74) *Attorney, Agent, or Firm* — Van Court & Aldridge LLP

(57) ABSTRACT

Cable structures with insulating tape and systems and methods for making the same are provided. In some embodiments, a cable may include a first group of conductors extending along a length of the cable, a tape wrapped directly around the first plurality of conductors along the length of the cable, and a second group of conductors extending along the length of the cable, where the tape electrically isolates the first group of conductors from the second group of conductors. The second group of conductors may extend around the tape or the tape may be wrapped directly around the second group of conductors. The tape may be a polymeric tape that may or may not include an adhesive.

22 Claims, 8 Drawing Sheets

(56) References Cited

U.S. PATENT DOCUMENTS

| | | | | |
|---|---|---|---|---|
| 7,411,132 | B1 * | 8/2008 | Medling | 174/113 R |
| 7,674,973 | B2 | 3/2010 | Cardas | |
| 7,790,981 | B2 | 9/2010 | Vaupotic et al. | |
| 2006/0054334 | A1 * | 3/2006 | Vaupotic et al. | 174/36 |
| 2011/0253415 | A1 | 10/2011 | Muschiatti et al. | |
| 2012/0193122 | A1 * | 8/2012 | Sugiyama et al. | 174/113 R |
| 2013/0167502 | A1 * | 7/2013 | Wilson et al. | 57/210 |
| 2014/0060913 | A1 * | 3/2014 | Hopkinson et al. | 174/350 |

* cited by examiner

CABLE STRUCTURES WITH INSULATING TAPE AND SYSTEMS AND METHODS FOR MAKING THE SAME

FIELD OF THE INVENTION

This can relate to cable structures and, more particularly, to cable structures with insulating tape and systems and methods for making the same.

BACKGROUND OF THE DISCLOSURE

Conventional cables used for data and/or power signal transmission typically include two or more groups of conductors that are electrically isolated from one another by a layer of insulation material that is extruded about one of the groups of conductors. Such extrusion requires a minimum thickness of insulation material to be extruded about the group of conductors to maintain concentricity of the conductors with respect to the insulation material for preventing the conductors from tearing through the insulation material. However, such a minimum thickness of extruded insulation material is often too large for desired cosmetic properties of the cable. Accordingly, alternative insulators for electrically isolating two or more groups of conductors within a cable are needed.

SUMMARY OF THE DISCLOSURE

Cable structures with insulating tape and systems and methods for making the same are provided.

A cable structure can include an insulating tape for electrically isolating two groups of conductors. Such tape may be substantially thinner than extruded insulation material typically used in conventional cables.

For example, in some embodiments, there is provided a cable that may include a first group of conductors that extends along a length of the cable, a tape wrapped directly around the first group of conductors along the length of the cable, and a second group of conductors that extends along the length of the cable, where the tape electrically isolates the first group of conductors from the second group of conductors.

In other embodiments, there is provided a cable that may include a first group of conductors that extends along a length of the cable, a tape wrapped along a helical path around the first group of conductors, and a second group of conductors that extends around the tape and along the length of the cable.

In yet other embodiments, there is provided a cable that may include a first group of conductors that extends along a length of the cable, a second group of conductors that extends along the length of the cable, and a tape. The tape is disposed directly around the first group of conductors along the length of the cable, and the tape is disposed directly around the second group of conductors along the length of the cable.

In yet other embodiments, there is provided a method of forming a cable that includes disposing a tape directly around a first group of conductors along a length of the cable, and disposing a second group of conductors along the length of the cable, where the tape electrically isolates the first group of conductors from the second group of conductors.

In yet other embodiments, there is provided a method of forming a cable that includes winding a tape directly around a first group of conductors and along a length of the cable, and disposing a second group of conductors around the tape and along the length of the cable.

In yet other embodiments, there is provided a method of forming a cable that includes disposing a first portion of a tape around a first group of conductors and along a length of the cable, and disposing a second portion of the tape around a second group of conductors and along the length of the cable.

BRIEF DESCRIPTION OF THE DRAWINGS

The above and other aspects of the invention, its nature, and various features will become more apparent upon consideration of the following detailed description, taken in conjunction with the accompanying drawings, in which like reference characters may refer to like parts throughout, and in which.

DETAILED DESCRIPTION OF THE DISCLOSURE

Cable structures with insulating tape and systems and methods for making the same are provided and described with reference to FIGS. 1-10.

A cable may include any suitable insulating tape for electrically isolating two groups of conductors. Such tape may be any polymeric tape with suitable dielectric performance, such as polyethylene terephthalate ("PET") tape (e.g., Mylar™ tape), which may be substantially thinner than extruded isolation material typically used in conventional cables.

Figure 1:
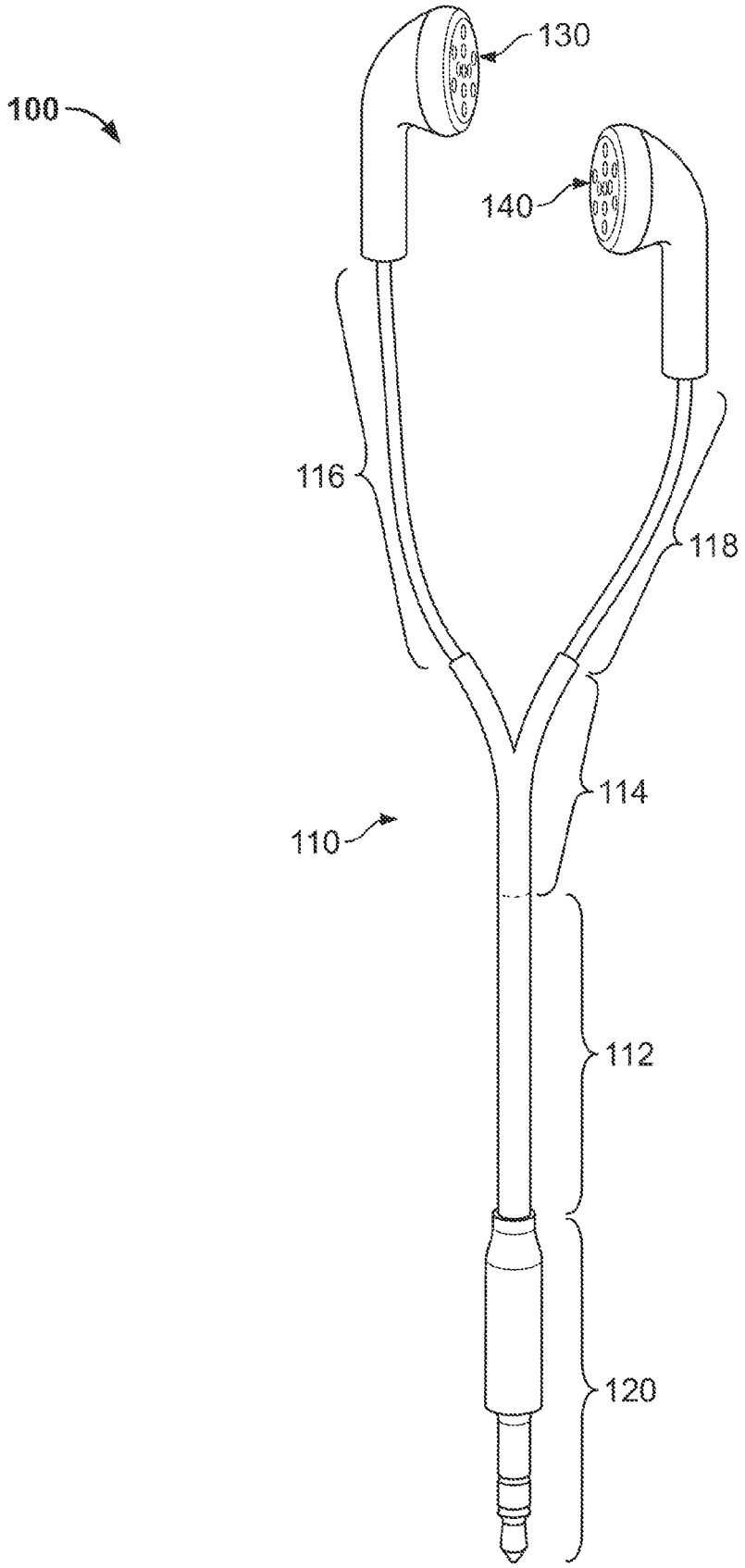
FIG. 1 is a perspective view of an illustrative headset assembly that includes a cable structure with insulating tape, in accordance with some embodiments of the invention.

A cable including insulating tape for electrically isolating two or more groups of conductors may be provided as part of any suitable cabled assembly. For example, as shown in FIG. 1, a cabled headset assembly 100 may include a cable 110 that can electrically couple an audio connector 120 to a left speaker 130 and/or a right speaker 140. Cable 110 may include a main region 112 that may extend between audio connector 120 and a bifurcation (e.g., forked region) 114 of cable 110. Cable 110 may also include a left region 116 that may extend between bifurcation 114 and left speaker 130. Alternatively or additionally, cable 110 may include a right region 118 that may extend between bifurcation 114 and right speaker 140. Any one or more of cable regions 112, 114, 116, and 118 of cable 110 may include insulating tape for electrically isolating two or more groups of conductors that may be configured to transmit data and/or power signals between audio connector 120 and one or both of left speaker 130 and right speaker 140. Cabled headset assembly 100 may be configured to transmit any suitable data signals, such as audio signals, video signals, control signals, and the like.

Figure 2:
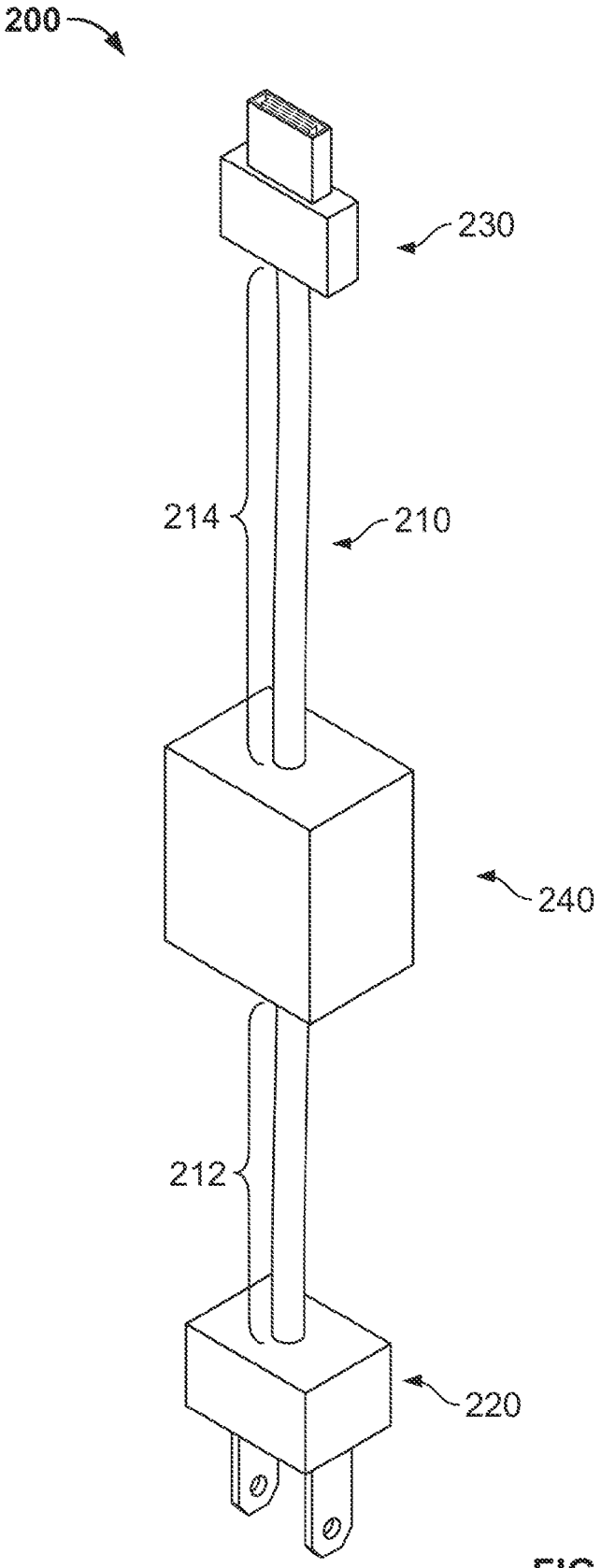
FIG. 2 is a perspective view of an illustrative power adaptor assembly that includes a cable structure with insulating tape, in accordance with some embodiments of the invention.

As another example, as shown in FIG. 2, a cable including insulating tape for electrically isolating two or more groups of conductors may be provided as part of a cabled power adaptor assembly 200, which may include a cable 210 that can electrically couple a mains power connector 220 and an electronic device connector 230. In some embodiments, power adaptor assembly 200 may also include an adaptor module 240 (e.g., for converting AC power signals to DC power signals), and cable 210 may include a first cable region 212 that may extend between mains power connector 220 and adaptor module 240 (e.g., for transmitting AC power signals between mains power connector 220 and adaptor module 240) as well as a second cable region 214 that may extend between adaptor module 240 and electronic device connector 230 (e.g., for transmitting DC power signals between adaptor module 240 and electronic device connector 230). Either one or both of cable regions 212 and 214 of cable 210 may include insulating tape for electrically isolating two or more groups of conductors that may be configured to transmit data and/or power signals between mains power connector 220 and electronic device connector 230.

Figure 3:
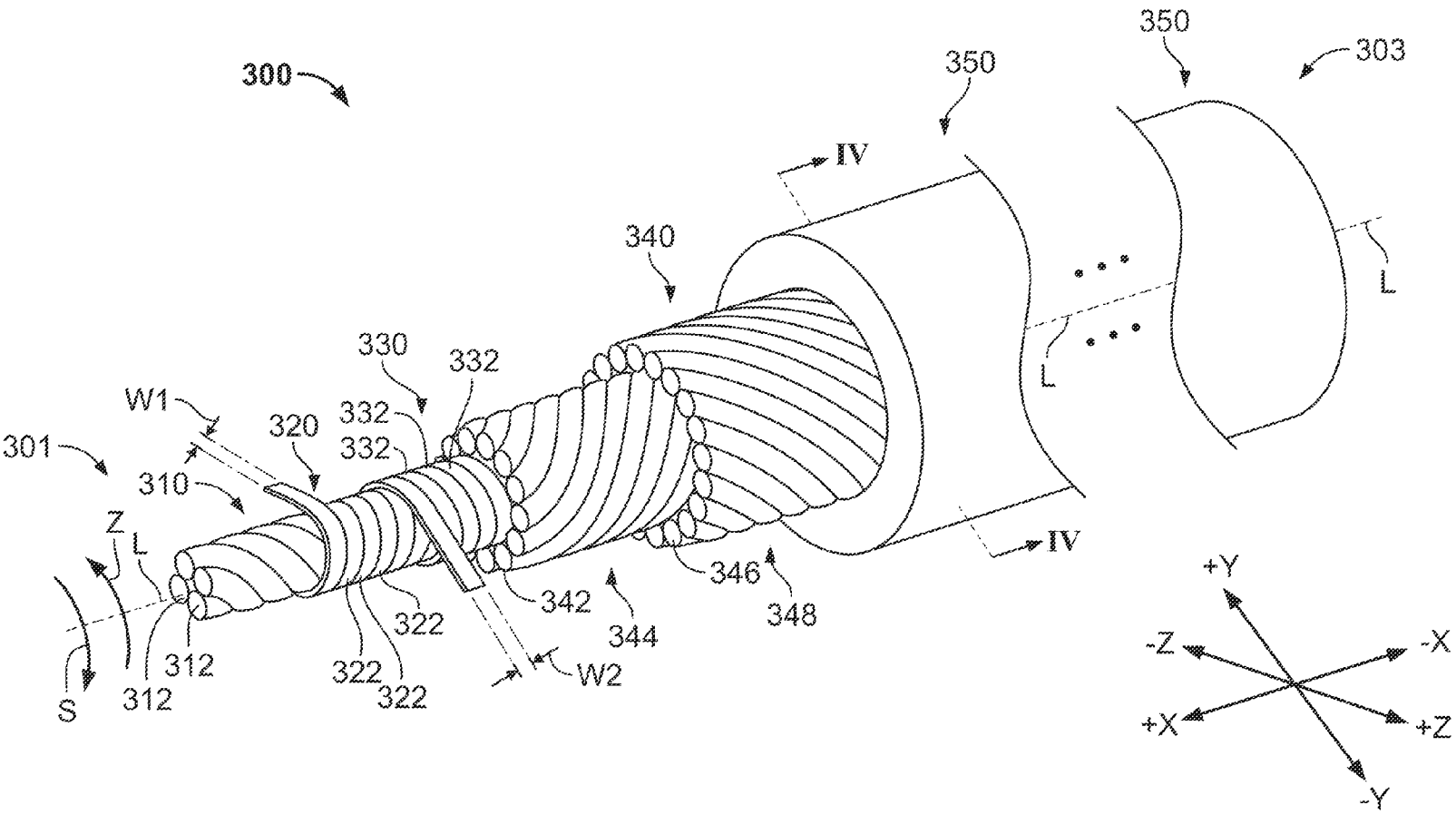
FIG. 3 is a partially broken-away perspective view of a portion of a cable structure with insulating tape, in accordance with some embodiments of the invention.
Figure 4:
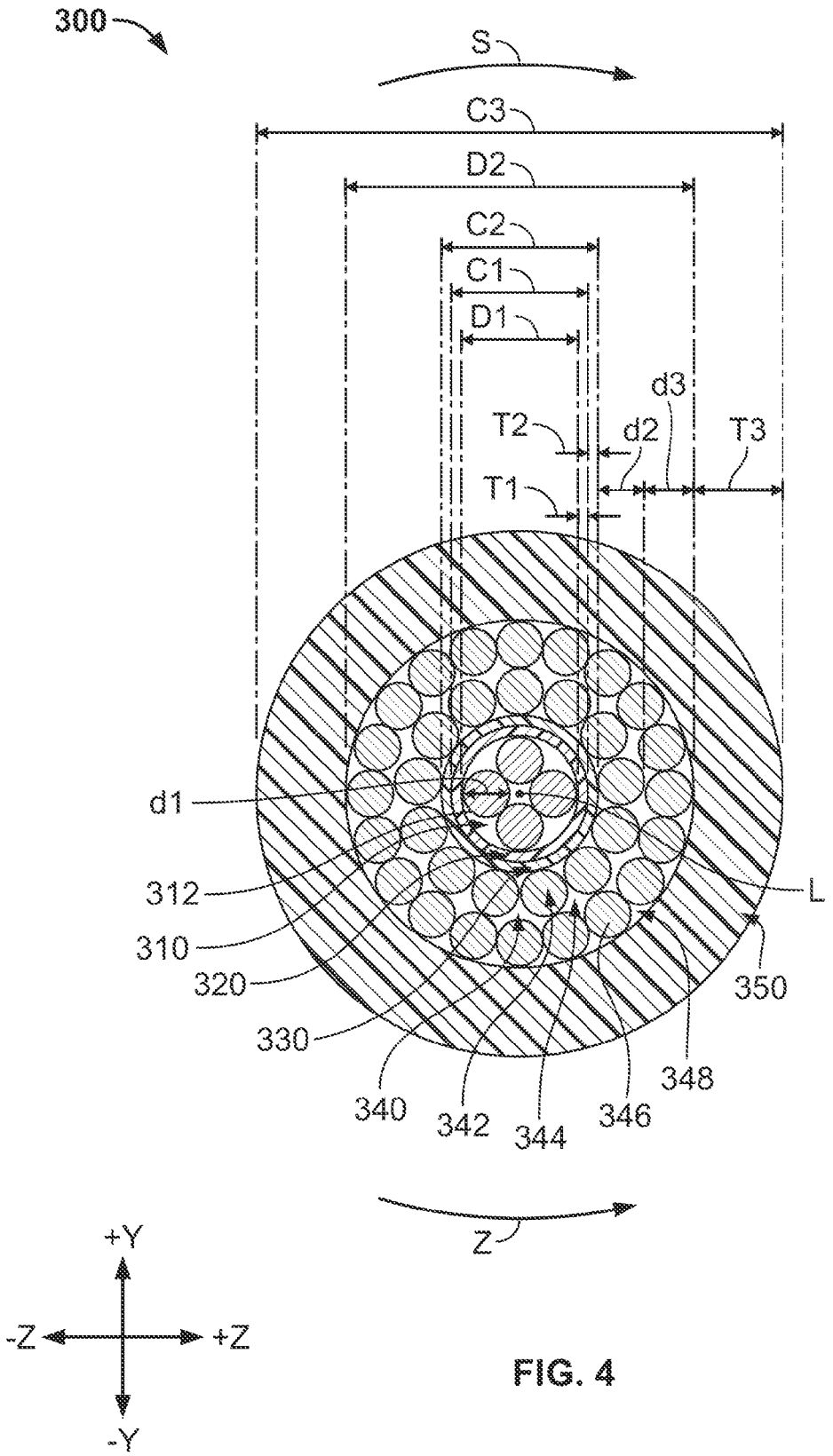
FIG. 4 is a cross-sectional view of the cable structure of FIG. 3, taken from line IV-IV of FIG. 3, in accordance with some embodiments of the invention.

FIG. 3 is a partially broken-away perspective view of a portion of an exemplary cable structure 300 (e.g., extending along the X-axis), while FIG. 4 is a cross-sectional view of cable structure 300 (e.g., in a Y-Z plane), taken from line IV-IV of FIG. 3. Cable structure 300 may be any suitable portion of any suitable cable region of any suitable cable that may be configured to transmit any suitable data signals and/or any suitable power signals. For example, cable structure 300 may be any suitable portion of one or more of cable regions 112, 114, 116, and 118 of cable 110 of FIG. 1, and/or cable structure 300 may be any suitable portion of one or more of cable regions 212 and 214 of cable 210 of FIG. 2.

Cable structure 300 may extend a length along a central longitudinal axis L from a first cable end 301 to an opposite second cable end 303 (e.g., along the X-axis of FIG. 3). Cable structure 300 may include a first group of conductors 310, an inner tape or first tape 320 that may be disposed around first conductor group 310, an outer tape or second tape 330 that may be disposed around first tape 320, a second group of conductors 340 that may be disposed around second tape 330, and a jacket 350 that may be disposed around the second conductor group 340. First tape 320 may be configured to electrically isolate first conductor group 310 from second conductor group 340. Starting at first cable end 301 and moving towards second cable end 303 of cable structure 300, portions of first tape 320, second tape 330, second conductor group 340, and jacket 350 have been progressively removed from FIG. 3 to more clearly illustrate the construction of cable structure 300.

First conductor group 310 may extend along a length of cable structure 300 (e.g., along central longitudinal axis L) from a first end proximate first cable end 301 to an opposite second end proximate second cable end 303. First conductor group 310 may include one or more conductors 312 that may be configured to electrically transmit signals between the ends of first conductor group 310. Each conductor 312 may be any suitable electrically conductive conductor that may be composed of any suitable material including, but not limited to, copper (e.g., a soft copper, a tin-plated soft copper, a silver-plated copper alloy, etc.), aluminum, steel, and any combination thereof. Although FIGS. 3 and 4 only show four (4) conductors 312 in first conductor group 310, it is to be understood that first conductor group 310 may include any suitable number of conductors, such as twenty (20) to twenty-five (25) conductors in some embodiments. Each conductor 312 may be of any suitable geometry and, as shown in FIG. 4, may have a diameter d1 or any other suitable cross-sectional width, while first conductor group 310 may have an overall diameter D1 or any other suitable cross-sectional width. For example, in some embodiments, diameter d1 of conductor 312 may be about 0.1016 millimeters, and diameter D1 of first conductor group 310 may be about 0.62 millimeters.

While first conductor group 310 may extend along central longitudinal axis L of cable structure 300, each conductor 312 of first conductor group 310 may be twisted in a lay direction about central longitudinal axis L along the length of cable structure 300. For example, each conductor 312 of first conductor group 310 may be twisted in a first lay direction S (e.g., a clockwise lay direction about axis L). Alternatively, as shown in FIG. 3, each conductor 312 of first conductor group 310 may be twisted in a second lay direction Z (e.g., a counter-clockwise lay direction about axis L) opposite to first lay direction S. Regardless of the lay direction in which each conductor 312 of first conductor group 310 may be twisted, the lay length of each conductor 312 (i.e., the distance required for a single conductor to be turned 360° about axis L) may be any suitable length, such as 7-11 millimeters.

First tape 320 may be disposed around first conductor group 310 along a length of cable structure 300 (e.g., from a first end proximate first cable end 301 to an opposite second end proximate second cable end 303). First tape 320 may be any suitable insulating tape having any suitable dielectric performance such that first tape 320 may electrically isolate first conductor group 310 from second conductor group 340. For example, first tape 320 may be any suitable polymeric tape that may include a polymeric sheet that may optionally include an adhesive portion on one or both surfaces. Such a polymeric sheet may be constructed from any suitable plastic, such as polyethylene terephthalate (e.g., PET, such as Mylar™), Kapton™ tape, and the like. First tape 320 may be of any suitable geometry and, as shown in FIGS. 3 and 4, first tape 320 may have a width W1, a thickness T1, and an overall diameter (or any other suitable cross-sectional width) C1. For example, in some embodiments, width W1 of first tape 320 may be about 5.00 millimeters, thickness T1 of first tape 320 may be about 0.015 millimeters, and overall diameter C1 of first tape 320 may be about 0.68 millimeters.

While first tape 320 may extend along central longitudinal axis L of cable structure 300, first tape 320 may be wrapped around first conductor group 310 in a particular lay direction about central longitudinal axis L along the length of cable structure 300. For example, as shown in FIG. 3, first tape 320 may be wrapped in a second lay direction Z (e.g., a counter-clockwise lay direction) about first conductor group 310. Alternatively, first tape 320 may be wrapped in a first lay direction S (e.g., a clockwise lay direction) opposite to second lay direction Z (not shown). In some embodiments, the lay direction in which first tape 320 may be wrapped about first conductor group 310 may be the same as or opposite to the lay direction in which conductors 312 of first conductor group 310 are twisted about axis L.

Regardless of the lay direction in which first tape 320 may be wrapped about first conductor group 310, first tape 320 may be wrapped along a first helical path around a periphery of first conductor group 310 and along at least a portion of the length of cable structure 300. A first end of first tape 320 proximate first cable end 301 is shown in FIG. 3 as being partially unwrapped for clarity. First tape 320 may be wound into winding turns 322 that may extend in helical paths around the periphery of first conductor group 310. In some embodiments, adjacent winding turns 322 of first tape 320 may overlap each other (e.g., except for the winding turn 322 at each end of first tape 320, each winding turn 322 of first tape 320 may overlap one of the adjacent winding turns 322 and may be overlapped by the other adjacent winding turn 322). For example, each winding turn 322 may overlap and/or be overlapped by an adjacent winding turn 322 of first tape 320 by any suitable amount, such as between 20% and 40% of width W1 of first tape 320, and such overlap may or may not be consistent along the length of cable structure 300. First tape 320 may be wrapped with any suitable lay direction and any suitable overlapping between adjacent winding turns 322 to appropriately retain conductors 312 of first conductor group 310 in a particular cross-sectional geometry (e.g., in a circular cross-sectional geometry having diameter D1, as shown in FIG. 4) and in the lengthwise geometry of cable structure 300. First tape 320 may also be configured to electrically isolate first conductor group 310 from any conductors provided about first tape 320 (e.g., the conductors of second conductor group 340).

In some embodiments, second tape 330 may be disposed around first tape 320 along a length of cable structure 300 (e.g., from a first end proximate first cable end 301 to an opposite second end proximate second cable end 303). Second tape 330 may be any suitable tape and may be similar to first tape 320. For example, second tape 330 may be any suitable polymeric tape that may include a polymeric sheet and an optional adhesive portion on one or both surfaces. Second tape 330 may be of any suitable geometry and, as shown in FIGS. 3 and 4, second tape 330 may have a width W2, a thickness T2, and an overall diameter (or any other suitable cross-sectional width) C2. For example, in some embodiments, width W2 of second tape 330 may be about 5.00 millimeters, thickness T2 of second tape 330 may be about 0.015 millimeters, and overall diameter C2 of second tape 330 may be about 0.74 millimeters.

While second tape 330 may extend along central longitudinal axis L of cable structure 300, second tape 330 may be wrapped around0 first tape 320 in a particular lay direction about central longitudinal axis L along the length of cable structure 300. For example, as shown in FIG. 3, second tape 330 may be wrapped in a first lay direction S (e.g., a clockwise lay direction) about first tape 320. Alternatively, second tape 330 may be wrapped in a second lay direction Z (e.g., a counter clockwise lay direction) opposite to first lay direction S (not shown). In some embodiments, the lay direction in which second tape 330 may be wrapped about first tape 320 may be the same as or opposite to the lay direction in which first tape 320 is wrapped about first conductor group 310. Moreover, in some embodiments, the lay direction in which second tape 330 may be wrapped about first tape 320 may be the same as or opposite to the lay direction in which conductors 312 of first conductor group 310 are twisted about axis L.

Regardless of the lay direction in which second tape 330 may be wrapped about first tape 320, second tape 330 may be wrapped along a second helical path around a periphery of first tape 320 and along at least a portion of the length of cable structure 300. A first end of second tape 330 proximate first cable end 301 is shown in FIG. 3 as being partially unwrapped for clarity. Second tape 330 may be wound into winding turns 332 that may extend in helical paths around the periphery of first tape 320. In some embodiments, adjacent winding turns 332 of second tape 330 may overlap each other (e.g., except for the winding turn 332 at each end of second tape 330, each winding turn 332 of second tape 330 may overlap one of the adjacent winding turns 332 and may be overlapped by the other adjacent winding turn 332). For example, each winding turn 332 may overlap and/or be overlapped by an adjacent winding turn 332 of second tape 330 by any suitable amount, such as between 20% and 40% of width W2 of second tape 330, and such overlap may or may not be consistent along the length of cable structure 300. Second tape 330 may be wrapped with any suitable lay direction and any suitable overlapping between adjacent winding turns 332 to appropriately bolster the mechanical properties of first tape 320 (e.g., the retention of first conductor group 310) and/or to appropriately bolster the electrical properties of first tape 320 (e.g., the electrical isolation of first conductor group 310). In some embodiments, first tape 320 may electrically isolate first conductor group 310 without any help from second tape 330, while second tape 330 may serve to bolster the mechanical retention of first conductor group 310 within first tape 320. In some embodiments, cable structure 300 does not include second tape 330 at all.

In some embodiments, an adhesive coating may be provided on at least one surface of first tape 320 and/or second tape 330. For example, in some embodiments, an adhesive may be provided on an internal surface of first tape 320 that may directly contact at least a portion of an outer surface of some conductors 312 of first conductor group 310, such that first tape 320 may more securely retain conductors 312 of first conductor group 310 in a particular geometry. Additionally or alternatively, in some embodiments, an adhesive may be provided on an external surface of first tape 320 that may directly contact at least a portion of an inner surface of second tape 330, and/or an adhesive may be provided on an internal surface of second tape 330 that may directly contact at least a portion of an outer surface of first tape 320, such that first tape 320 and second tape 330 may more securely retain their relative positions with respect to one another along the length of cable structure 300. Additionally or alternatively, in some embodiments that do not include second tape 330 within cable structure 300, an adhesive may be provided on an external surface of first tape 320 that may directly contact at least a portion of an inner surface of some conductors of second conductor group 340, such that first tape 320 may more securely retain conductors of second conductor group 340 in a particular geometry. Additionally or alternatively, in some embodiments that do include second tape 330 within cable structure 300, an adhesive may be provided on an external surface of second tape 330 that may directly contact at least a portion of an inner surface of some conductors of second conductor group 340, such that second tape 330 may more securely retain conductors of second conductor group 340 in a particular geometry. In yet other embodiments, no adhesive may be provided on any surface of first tape 320 and/or second tape 330.

Second conductor group 340 may extend along a length of cable structure 300 (e.g., along central longitudinal axis L) from a first end proximate first cable end 301 to an opposite second end proximate second cable end 303. Second conductor group 340 may include one or more conductors 342 that may be configured to electrically transmit signals between the ends of second conductor group 340. In some embodiments, as shown, second conductor group 340 may include an inner layer 344 of conductors 342 disposed about first tape 320 and at least one outer layer 348 of conductors 346 disposed about inner layer 344. Each one of conductors 342 and 346 of second conductor group 340 may be any suitable electrically conductive conductor, and may be similar to conductors 312 of first conductor group 310. It is to be understood that second conductor group 340 may include any suitable number of conductors. For example, inner layer 344 may include twenty-one (21) to twenty-five (25) conductors 342 and outer layer 348 may include twenty-seven (27) to thirty-one (31) conductors 346. Each conductor 342 and each conductor 346 may be of any suitable geometry and, as shown in FIG. 4, may have respective diameters (or any other suitable cross-sectional widths) d2 and d3, while second conductor group 340 may have an overall diameter D2 or any other suitable cross-sectional width. For example, in some embodiments, diameter d2 of conductor 342 may be about 0.1016 millimeters, diameter d3 of conductor 346 may be about 0.1016 millimeters, and diameter D2 of second conductor group 340 may be about 1.20 millimeters.

While second conductor group 340 may extend along central longitudinal axis L of cable structure 300, each conductor 342 of inner layer 344 of second conductor group 340 may be twisted in a lay direction about central longitudinal axis L along the length of cable structure 300. For example, each conductor 342 of inner layer 344 of second conductor group 340 may be twisted in a second lay direction Z (e.g., a counter-clockwise lay direction about axis L). Alternatively, as shown in FIG. 3, each conductor 342 of inner layer 344 of second conductor group 340 may be twisted in a first lay direction S (e.g., a clockwise lay direction about axis L) opposite to second lay direction Z. In some embodiments, the lay direction in which each conductor 342 of inner layer 344 of second conductor group 340 may be twisted may be the same as or opposite to the lay direction in which conductors 312 of first conductor group 310 are twisted about axis L. Moreover, in some embodiments, the lay direction in which each conductor 342 of inner layer 344 of second conductor group 340 may be twisted may be the same as or opposite to the lay direction in which first tape 320 is wrapped about first conductor group 310. Moreover, in some embodiments, the lay direction in which each conductor 342 of inner layer 344 of second conductor group 340 may be twisted may be the same as or opposite to the lay direction in which second tape 330 is wrapped about first tape 320.

Similarly, while second conductor group 340 may extend along central longitudinal axis L of cable structure 300, each conductor 346 of outer layer 348 of second conductor group 340 may be twisted in a lay direction about central longitudinal axis L along the length of cable structure 300. For example, each conductor 346 of outer layer 348 of second conductor group 340 may be twisted in a first lay direction S (e.g., a clockwise lay direction about axis L). Alternatively, as shown in FIG. 3, each conductor 346 of outer layer 348 of second conductor group 340 may be twisted in a second lay direction Z (e.g., a counter-clockwise lay direction about axis L) opposite to first lay direction S. In some embodiments, the lay direction in which each conductor 346 of outer layer 348 of second conductor group 340 may be twisted may be the same as or opposite to the lay direction in which conductors 312 of first conductor group 310 are twisted about axis L. Moreover, in some embodiments, the lay direction in which each conductor 346 of outer layer 348 of second conductor group 340 may be twisted may be the same as or opposite to the lay direction in which first tape 320 is wrapped about first conductor group 310. Moreover, in some embodiments, the lay direction in which each conductor 346 of outer layer 348 of second conductor group 340 may be twisted may be the same as or opposite to the lay direction in which second tape 330 is wrapped about first tape 320.

The lay direction in which each conductor 346 of outer layer 348 of second conductor group 340 may be twisted may be the same as or opposite to the lay direction in which each conductor 342 of inner layer 344 of second conductor group 340 may be twisted. However, in some particular embodiments, the lay direction of each conductor 346 of outer layer 348 of second conductor group 340 may be opposite to the lay direction of each conductor 342 of inner layer 344 of second conductor group 340 such that inner layer 344 and outer layer 348 may provide counter-rotating spirals of any suitable offset angle (e.g., an offset angle between 11 and 19°).

Jacket 350 may be disposed around second conductor group 340 along a length of cable structure 300 (e.g., from a first end proximate first cable end 301 to an opposite second end proximate second cable end 303). Jacket 350 may be any suitable insulating and/or conductive material that may be extruded about second conductor group 340 for protecting the internal structure of cable structure 300 from environmental threats (e.g., impact damage, debris, heat, fluids, and the like). For example, jacket 350 may be a thermoplastic copolyester ("TPC") (e.g., Arnitel™ XG5857) that can be extruded around the outer periphery of second conductor group 340. Jacket 350 may be provided around the outer periphery of second conductor group 340 with any suitable uniform thickness T3 and may provide an overall diameter (or any other suitable cross-sectional width) C3 for cable structure 300. For example, in some embodiments, thickness T3 of jacket 350 may be about 0.40 millimeters, and overall diameter C3 of jacket 350 may be about 2.00 millimeters.

Therefore, cable structure 300 may be provided with first tape 320 that may electrically isolate first conductor group 310 from second conductor group 340. First tape 320 may be wrapped directly around first conductor group 310, and second conductor group 340 may extend around first tape 320. In some embodiments, as shown, first conductor group 310 and second conductor group 340 may be concentric and may each extend about longitudinal axis L. Therefore, a central axis of each one of first conductor group 310 and second conductor group 340 may be the same as longitudinal axis L of cable structure 300. Moreover, in some embodiments, as shown in FIG. 4, for example, first conductor group 310 may have a cross-sectional area with a circular shape and second conductor group 340 may have a cross-sectional area with an annular shape. Although it is to be understood that the size and shape of each one of first conductor group 310 and second conductor group 340 may be any suitable size and shape. The shape of first conductor group 310 may be defined and retained by first tape 320, whereas the shape of second conductor group 340 may be defined and retained by jacket 350 and first tape 320 and/or second tape 330.

Figure 5:
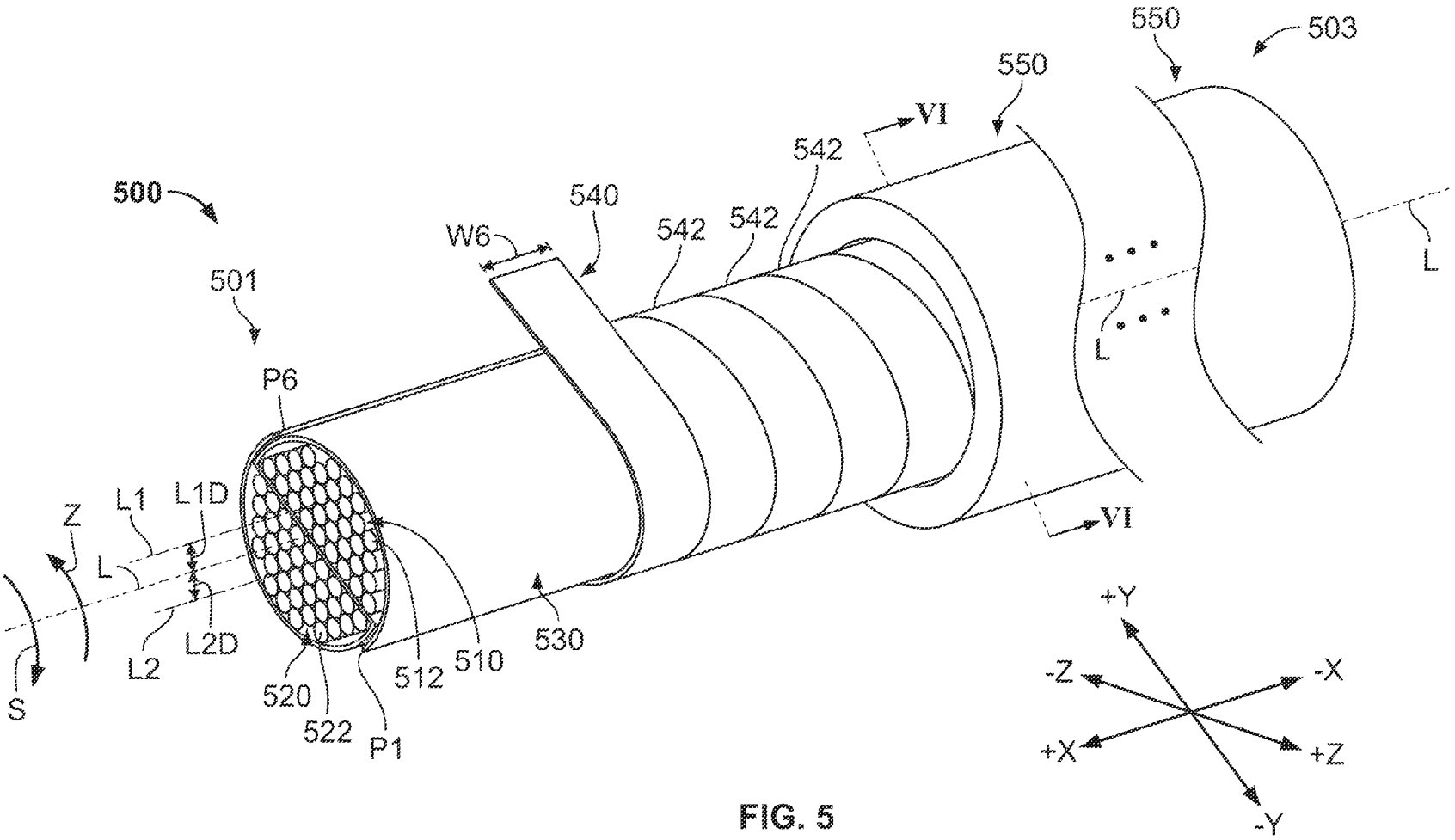
FIG. 5 is a partially broken-away perspective view of a portion of a cable structure with insulating tape, in accordance with some other embodiments of the invention.
Figure 6:
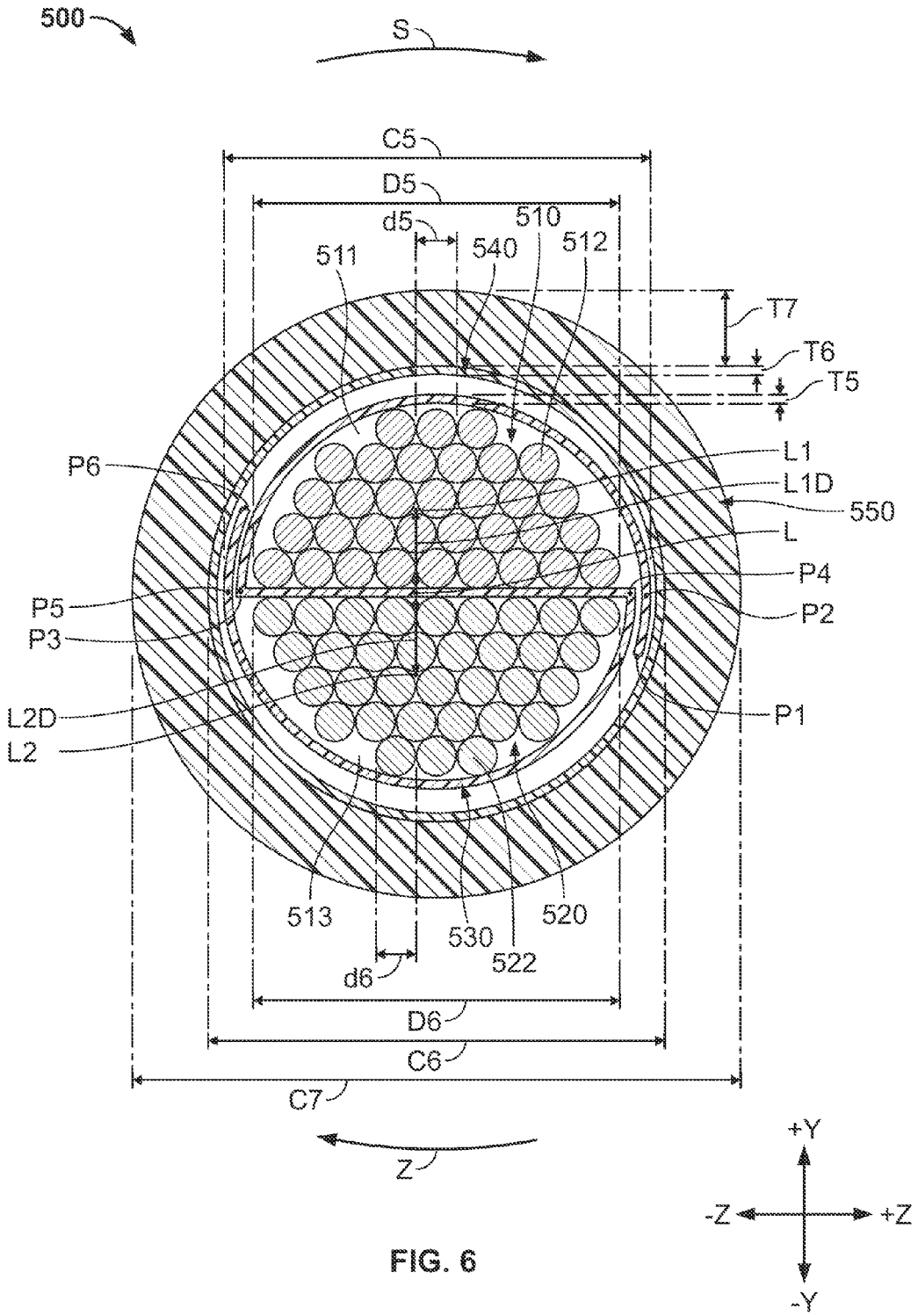
FIG. 6 is a cross-sectional view of the cable structure of FIG. 5, taken from line VI-VI of FIG. 5, in accordance with some embodiments of the invention.

FIG. 5 is a partially broken-away perspective view of a portion of an exemplary cable structure 500 (e.g., extending along the X-axis), while FIG. 6 is a cross-sectional view of cable structure 500 (e.g., in a Y-Z plane), taken from line VI-VI of FIG. 5. Cable structure 500 may be any suitable portion of any suitable cable region of any suitable cable that may be configured to transmit any suitable data signals and/or any suitable power signals. For example, cable structure 500 may be any suitable portion of one or more of cable regions 112, 114, 116, and 118 of cable 110 of FIG. 1, and/or cable structure 500 may be any suitable portion of one or more of cable regions 212 and 214 of cable 210 of FIG. 2.

Cable structure 500 may extend a length along a central longitudinal axis L from a first cable end 501 to an opposite second cable end 503 (e.g., along the X-axis of FIG. 5). Cable structure 500 may include a first group of conductors 510, a second group of conductors 520, an inner tape or first tape 530 that may be disposed around first conductor group 510 and around second conductor group 520, an outer tape or second tape 540 that may be disposed around first tape 530, and a jacket 550 that may be disposed around second tape 540. First tape 530 may be configured to electrically isolate first conductor group 510 from second conductor group 520. Starting at first cable end 501 and moving towards second cable end 503 of cable structure 500, portions of second tape 540 and jacket 550 have been progressively removed from FIG. 5 to more clearly illustrate the construction of cable structure 500.

First conductor group 510 may extend along a length of cable structure 500 (e.g., along a first conductor group central axis L1 that may adjacent to central longitudinal axis L) from a first end proximate first cable end 501 to an opposite second end proximate second cable end 503. At any cross-section of cable structure 500 taken perpendicularly to axis L (e.g., the cross-section of FIG. 6), central axis L1 of first conductor group 510 may be distanced from central longitudinal axis L by a fixed distance L1D. First conductor group 510 may include one or more conductors 512 that may be configured to electrically transmit signals between the ends of first conductor group 510. Each conductor 512 may be any suitable electrically conductive conductor that may be composed of any suitable material including, but not limited to, copper (e.g., a soft copper, a tin-plated soft copper, a silver-plated copper alloy, etc.), aluminum, steel, and any combination thereof. Although FIGS. 5 and 6 only show thirty-three (33) conductors 512 in first conductor group 510, it is to be understood that first conductor group 510 may include any suitable number of conductors, such as thirty-one (31) to thirty-five (35) conductors in some embodiments. Each conductor 512 may be of any suitable geometry and, as shown in FIG. 6, may have a diameter d5 or any other suitable cross-sectional width, while first conductor group 510 may be semi-circular with an overall diameter D5 or any other suitable cross-sectional width. For example, in some embodiments, diameter d5 of conductor 512 may be about 0.1016 millimeters, and diameter D5 of first conductor group 510 may be about 1.04 millimeters.

Second conductor group 520 may extend along a length of cable structure 500 (e.g., along a second conductor group central axis L2 that may adjacent to central longitudinal axis L) from a first end proximate first cable end 501 to an opposite second end proximate second cable end 503. At any cross-section of cable structure 500 taken perpendicularly to axis L (e.g., the cross-section of FIG. 6), central axis L2 of second conductor group 520 may be distanced from central longitudinal axis L by a fixed distance L2D. Moreover, as shown in FIGS. 5 and 6, first conductor group central axis L1 and second conductor group central axis L2 may be on opposite sides of central longitudinal axis L of cable structure 500 (e.g., axis L may run halfway in between axis L1 and axis L2, where L1 and L2 may be equal and/or linear at any cross-section of cable structure 500). Second conductor group 520 may include one or more conductors 522 that may be configured to electrically transmit signals between the ends of second conductor group 520. Each conductor 522 may be any suitable electrically conductive conductor that may be composed of any suitable material including, but not limited to, copper (e.g., a soft copper, a tin-plated soft copper, a silver-plated copper alloy, etc.), aluminum, steel, and any combination thereof. Although FIGS. 5 and 6 only show thirty-three (33) conductors 522 in second conductor group 520, it is to be understood that second conductor group 520 may include any suitable number of conductors, such as thirty-one (31) to thirty-five (35) conductors in some embodiments. Each conductor 522 may be of any suitable geometry and, as shown in FIG. 6, may have a diameter d6 or any other suitable cross-sectional width, while second conductor group 520 may be semi-circular with an overall diameter D6 or any other suitable cross-sectional width. For example, in some embodiments, diameter d6 of conductor 522 may be about 0.1016 millimeters, and diameter D6 of second conductor group 520 may be about 1.04 millimeters. While FIGS. 5 and 6 may show second conductor group 520 to be shaped similarly to first conductor group 510 and while FIGS. 5 and 6 may show each conductor 512 to be shaped similarly to each conductor 522, it is to be understood that first conductor group 510 and second conductor group 520 may each be shaped differently and may each include different numbers of conductors of different sizes and shapes.

First tape 530 may be disposed around first conductor group 510 along a length of cable structure 500 (e.g., from a first end proximate first cable end 301 to an opposite second end proximate second cable end 303) as well as around second conductor group 520 along a length of cable structure 500 (e.g., from a first end proximate first cable end 301 to an opposite second end proximate second cable end 303). First tape 530 may be any suitable insulating tape having any suitable dielectric performance such that first tape 530 may electrically isolate first conductor group 510 from second conductor group 520. For example, first tape 530 may be any suitable polymeric tape that may include a polymeric sheet that may optionally include an adhesive portion on one or both surfaces. Such a polymeric sheet may be constructed from any suitable plastic, such as polyethylene terephthalate (e.g., PET, such as Mylar™), Kapton™ tape, and the like. First tape 530 may be of any suitable geometry and, as shown in FIGS. 5 and 6, first tape 530 may have a width W5, a thickness T5, and an overall diameter (or any other suitable cross-sectional width) C5. For example, in some embodiments, width W5 of first tape 530 may be about 6.50 millimeters, thickness T5 of first tape 530 may be about 0.025 millimeters, and overall diameter C5 of first tape 530 may be about 1.14 millimeters.

While first tape 530 may extend along central longitudinal axis L of cable structure 500, a portion of first tape 530 may be disposed about first conductor group 510 and a portion of first tape 530 may be disposed about second conductor group 520. For example, a first portion of first tape 530 (e.g., the portion of first tape 530 extending from point P4 to at least point P2 in FIG. 6) may define a first interior region 511 and may be disposed around conductors 512 of first conductor group 510. As shown, for example, points P2 and P4 of first tape 530 may contact each other such that a first portion of first tape 530 extending between points P2 and P4 may surround conductors 512 of first conductor group 510 and/or may electrically isolate conductors 512 of first conductor group 510 from conductors 522 of second conductor group 520. Alternatively or additionally, a second portion of first tape 530 (e.g., the portion of first tape 530 extending from point P3 to at least point P5 in FIG. 6) may define a second interior region 513 and may be disposed around conductors 522 of second conductor group 520. As shown, for example, points P3 and P5 of first tape 530 may contact each other such that a second portion of first tape 530 extending between points P3 and P5 may surround conductors 522 of second conductor group 520 and/or may electrically isolate conductors 522 of second conductor group 520 from conductors 512 of first conductor group 510. Therefore, first tape 530 may be substantially "S-shaped," whereby a first portion of first tape 530 may be disposed around first conductor group 510 for defining first interior region 511 along the length of cable structure 500, and whereby a second portion of first tape 530 may be disposed around second conductor group 520 for defining second interior region 513 along the length of cable structure 500. It is to be understood that, although each one of first interior region 511 and second interior region 513 may be shown in FIGS. 5 and 6 to be semi-circular and of substantially the same size, each one of first interior region 511 and second interior region 513 may be of a different size and a different shapes from each other in other embodiments.

In some embodiments, a specific portion of first tape 530 may directly separate first conductor group 510 from second conductor group 520. For example, as shown, a third portion of first tape 530, which may extend between points P3 and P4, may be included as both (1) a part of the first portion of first tape 530 that may be disposed around conductors 512 of first conductor group 510 (e.g., the portion of first tape 530 extending from point P4 to at least point P2 in FIG. 6) as well as (2) a part of the second portion of first tape 530 that may be disposed around conductors 522 of second conductor group 520 (e.g., the portion of first tape 530 extending from point P3 to at least point P5 in FIG. 6). The length of such a third portion of first tape 530 between points P3 and P4 within any given cross-section of cable structure 500 (e.g., within FIG. 6) may be equal to or greater than a third of the diameter or suitable cross-sectional length of cable structure 500. For example, the length of first tape 530 between points P3 and P4 may be at least a third of the length of diameter C7 of jacket 550. Moreover, in some embodiments, an additional portion of first tape 530 may extend between points P2 and P1, which may define the amount of a first overlap of first tape 530 with itself (e.g., about second conductor group 520). Alternatively or additionally, an additional portion of first tape 530 may extend between points P5 and P6, which may define the amount of a second overlap of first tape 530 with itself (e.g., about first conductor group 510).

While first conductor group 510 and second conductor group 520 may, respectively, extend along first conductor group axis L1 and second conductor group axis L2 (e.g., parallel to central longitudinal axis L of cable structure 300), first conductor group 510 (e.g., each conductor 512) and second conductor group 520 (e.g., each conductor 522) may be twisted in a first lay direction about central longitudinal axis L along the length of cable structure 300. For example, as shown in FIG. 5, first conductor group 510 and second conductor group 520 may be twisted in a first lay direction S (e.g., a clockwise lay direction about axis L). Alternatively, first conductor group 510 and second conductor group 520 may be twisted in a second lay direction Z (e.g., a counter-clockwise lay direction about axis L) opposite to first lay direction S. Regardless of the lay direction in which each one of first conductor group 510 and second conductor group 520 may be twisted, the lay length of each conductor (e.g., conductors 512 and 522) of first conductor group 510 and second conductor group 520 (i.e., the distance required for a single conductor to be turned 360° about axis L) may be any suitable length, such as 10-16 millimeters.

In some embodiments, at least one of the edges of first tape 530 (e.g., the edge at P1 and/or the edge at P6) may be wound in a particular lay direction about central longitudinal axis L along the length of cable structure 300. When first tape 530 is disposed with respect to first conductor group 510 and second conductor group 520 as shown in FIGS. 5 and 6, such winding of an edge of first tape 530 in a particular lay direction about central longitudinal axis L may similarly twist conductors 512 of first conductor group 510 and conductors 522 of second conductor group 520 in that same particular lay direction. For example, in some embodiments, first conductor group 510 and second conductor group 520 may be twisted in a first lay direction S (e.g., a clockwise lay direction about axis L) as an edge of first tape 530 is wound in first lay direction S. Alternatively, first conductor group 510 and second conductor group 520 may be twisted in a second lay direction Z (e.g., a counter clockwise lay direction about axis L) as an edge of first tape 530 is wound in second lay direction Z. Regardless of the lay direction in which an edge of first tape 530 may be wrapped about longitudinal axis L, first tape 530 may be wrapped around a periphery of first conductor group 510, around a periphery of second conductor group 520, and between first conductor group 510 and second conductor group 520.

In some embodiments, second tape 540 may be disposed around first tape 530 along a length of cable structure 500 (e.g., from a first end proximate first cable end 501 to an opposite second end proximate second cable end 503). Second tape 540 may be any suitable tape and may be similar to first tape 530. For example, second tape 540 may be any suitable polymeric tape that may include a polymeric sheet and an optional adhesive portion on one or both surfaces. Second tape 540 may be of any suitable geometry and, as shown in FIGS. 5 and 6, second tape 540 may have a width W6, a thickness T6, and an overall diameter (or any other suitable cross-sectional width) C6. For example, in some embodiments, width W6 of second tape 540 may be about 3.00 millimeters, thickness T6 of second tape 540 may be about 0.015 millimeters, and overall diameter C6 of second tape 540 may be about 1.20 millimeters.

While second tape 540 may extend along central longitudinal axis L of cable structure 500, second tape 540 may be wrapped around first tape 530 in a particular lay direction about central longitudinal axis L along the length of cable structure 500. For example, as shown in FIG. 5, second tape 540 may be wrapped in a second lay direction Z (e.g., a counter clockwise lay direction) about first tape 530. Alternatively, second tape 540 may be wrapped in a first lay direction S (e.g., a clockwise lay direction) opposite to second lay direction Z (not shown). In some embodiments, the lay direction in which second tape 540 may be wrapped about first tape 530 may be the same as or opposite to the lay direction in which first tape 530 is wrapped about longitudinal axis L. Moreover, in some embodiments, the lay direction in which second tape 540 may be wrapped about first tape 530 may be the same as or opposite to the lay direction in which first conductor group 510 is twisted about axis L.

Regardless of the lay direction in which second tape 540 may be wrapped about first tape 530, second tape 540 may be wrapped along a second helical path around a periphery of first tape 530 and along at least a portion of the length of cable structure 500. A first end of second tape 540 proximate first cable end 501 is shown in FIG. 5 as being partially unwrapped for clarity. Second tape 540 may be wound into winding turns 542 that may extend in helical paths around the periphery of first tape 530. In some embodiments, adjacent winding turns 542 of second tape 540 may overlap each other (e.g., except for the winding turn 542 at each end of second tape 540, each winding turn 542 of second tape 540 may overlap one of the adjacent winding turns 542 and may be overlapped by the other adjacent winding turn 542). For example, each winding turn 542 may overlap and/or be overlapped by an adjacent winding turn 542 of second tape 540 by any suitable amount, such as between 20% and 40% of width W6 of second tape 540, and such overlap may or may not be consistent along the length of cable structure 500. Second tape 540 may be wrapped with any suitable lay direction and any suitable overlapping between adjacent winding turns 542 to appropriately bolster the mechanical properties of first tape 530 (e.g., the retention of first conductor group 510 and/or second conductor group 520).

In some embodiments, first tape 530 may electrically isolate first conductor group 510 from second conductor group 520 without any help from second tape 540, while second tape 540 may serve to bolster the mechanical retention of first conductor group 510 and second conductor group 520 within first tape 530. For example, second tape 540 may bolster the mechanical retention of first conductor group 510 within first tape 530 between points P4 and P2 of first tape 530 when there is little to no additional portion of first tape 530 extending between points P2 and P1 of first tape 530 (e.g., second tape 540 may be disposed around first tape 530 to bolster mechanical retention capabilities of first tape 530 when first tape 530 does not overlap itself to a certain degree). In some embodiments, cable structure 500 does not include second tape 540 at all.

In some embodiments, an adhesive coating may be provided on at least one surface of first tape 530 and/or second tape 540. For example, in some embodiments, an adhesive may be provided on at least a portion of a first surface of first tape 530 that may directly contact at least a portion of an outer surface of some conductors 512 of first conductor group 510, such that first tape 530 may more securely retain conductors 512 of first conductor group 510 in a particular geometry. Additionally or alternatively, in some embodiments, an adhesive may be provided on at least a portion of a second surface of first tape 530 that may directly contact at least a portion of an outer surface of some conductors 522 of second conductor group 520, such that first tape 530 may more securely retain conductors 522 of second conductor group 520 in a particular geometry.

In some embodiments, an adhesive may be provided on at least a portion of one or both of the surfaces of first tape 530 that may directly contact at least a portion of an inner surface of second tape 540, and/or an adhesive may be provided on an internal surface of second tape 540 that may directly contact at least a portion of one or more surfaces of first tape 530, such that first tape 530 and second tape 540 may more securely retain their relative positions with respect to one another along the length of cable structure 500. Additionally or alternatively, in some embodiments that do not include second tape 540 within cable structure 500, an adhesive may be provided on at least a portion of one or both surfaces of first tape 530 that may directly contact at least a portion of an inner surface of jacket 550, such that first tape 530 may more securely retain conductors of first conductor group 510 and/or second conductor group 520 in a particular geometry with respect to jacket 550. Additionally or alternatively, in some embodiments that do include second tape 540 within cable structure 500, an adhesive may be provided on at least a portion of an external surface of second tape 540 that may directly contact at least a portion of an inner surface of jacket 550, such that second tape 540 may more securely retain first tape 530 in a particular geometry with respect to jacket 550. In yet other embodiments, no adhesive may be provided on any surface of first tape 530 and/or second tape 540.

Jacket 550 may be disposed around first tape 530 along a length of cable structure 500 (e.g., from a first end proximate first cable end 301 to an opposite second end proximate second cable end 303). When cable structure 500 also includes second tape 540, jacket 550 may be disposed directly around second tape 540 along a length of cable structure 500. Jacket 550 may be any suitable insulating and/or conductive material that may be extruded about first tape 530 and/or second tape 540 for protecting the internal structure of cable structure 500 from environmental threats (e.g., impact damage, debris, heat, fluids, and the like). For example, jacket 550 may be a thermoplastic copolyester ("TPC") (e.g., Arnitel™ XG5857) that can be extruded around the outer periphery of first tape 530 and/or second tape 540. Jacket 550 may be provided around the outer periphery of first tape 530 and/or second tape 540 with any suitable uniform thickness T7 and may provide an overall diameter (or any other suitable cross-sectional width) C7 for cable structure 500. For example, in some embodiments, thickness T7 of jacket 550 may be about 0.40 millimeters, and overall diameter C7 of jacket 550 may be about 2.00 millimeters.

Therefore, cable structure 500 may be provided with first tape 530 that may electrically isolate first conductor group 510 from second conductor group 520. First tape 530 may be disposed directly around first conductor group 510 and directly around second conductor group 520, while second tape 540 may be disposed directly around first tape 530. In some embodiments, as shown, first conductor group 510 and second conductor group 520 may extend parallel to one another and along longitudinal axis L (e.g., center axis L1 of first conductor group 510 and center axis L2 of second conductor group 520 may always be separated from one another by a distance (e.g., the sum of distances L1D and L2D)). Therefore, a central axis of each one of first conductor group 510 and second conductor group 520 may be removed from longitudinal axis L of cable structure 500 at any cross-section along the length of cable structure 500 (e.g., as shown in FIG. 6).

First tape 530 may at least partially define and retain the cross-sectional shape of each one of first conductor group 510 and second conductor group 520 as similar shapes, complimentary shapes, or different shapes. In some embodiments, as shown in FIG. 6, for example, first interior region 511 of first tape 530 about first conductor group 510 may have a cross-sectional area with a first semi-circular shape and second interior region 513 of first tape 530 about second conductor group 520 may have a cross-sectional area with a second semi-circular shape. The shape of first interior region 511 about first conductor group 510 may be defined by at least a first portion of first tape 530 (e.g., between points P2 and P4 of first tape 530) as a first semicircle, whereas the shape of second interior region 513 about second conductor group 520 may be defined by at least a second portion of first tape 530 (e.g., between points P3 and P5 of first tape 530) as a second semicircle. A first segment of the first portion of first tape 530 (e.g., between points P3 and P4 of first tape 530) may define and retain the diameter of the first semicircle of first interior region 511 (e.g., diameter D5 of first conductor group 510), while at least a part of that first segment of first tape 530 (e.g., between points P3 and P4 of first tape 530) may define and retain the diameter of the second semicircle of second interior region 513 (e.g., diameter D6 of second conductor group 520). In such embodiments, as shown in FIG. 6, for example, by retaining the diameter of a semi-circular first conductor group 510 against the diameter of a semi-circular second conductor group 520 using a common portion of a segment of first tape 530 (e.g., a common portion of a segment between points P3 and P4 of first tape 530), the arc of each semi-circular conductor group (e.g., the arc of each semi-circular interior region 511/513) may be opposite one another, thereby allowing the outer most surfaces of first tape 530 to form a curved cross-section (e.g., a circular cross-section when each one of semi-circular interior regions 511 and 513 is similarly shaped and sized, as shown in FIG. 6). This may allow for cable structure 500 to have a circular cross-section while also packing as many conductors (e.g., conductors 512 and 522) as possible within the interior of first tape 530. That is, two semi-circular cross-sectional interior regions 511 and 513 of first tape 530 may fit within a circular cross-sectional interior region of cable structure 500 without first tape 530 requiring any additional space besides that of its interior regions.

It is to be understood, however, that the cross-sectional size and shape of first interior region 511 provided by first tape 530 for defining and retaining the geometry of first conductor group 510 may be any suitable size and shape that may be the same as or different than the size and shape of second interior region 513 provided by first tape 530 for defining and retaining the geometry of second conductor group 520. For example, first interior region 511 may be a quadrangle while second interior region 513 may be circular. Moreover, in some embodiments, a first tape may define first interior region 511, a second tape may define second interior region 513, and a third tape may be disposed about such a first tape and such a second tape.

Figure 7:
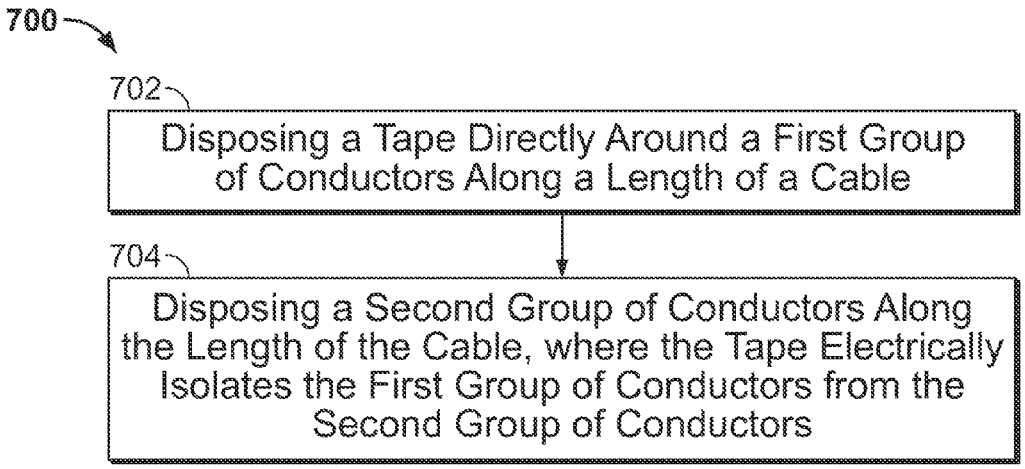
FIGS. 7-9 are flowcharts of illustrative processes for manufacturing cable structures, in accordance with various embodiments of the invention.

FIG. 7 is a flowchart of an illustrative process 700 for forming a cable. At step 702 of process 700, a first tape may be disposed directly around a first group of conductors and along a length of the cable. For example, as described with respect to FIGS. 3 and 4, first tape 320 may be disposed directly around first conductor group 310 along a length of cable structure 300. As another example, as described with respect to FIGS. 5 and 6, first tape 530 may be disposed directly around first conductor group 510 along a length of cable structure 500. At step 704 of process 700, a second group of conductors may be disposed along the length of the cable, where the first tape electrically isolates the first group of conductors from the second group of conductors. For example, as also described with respect to FIGS. 3 and 4, second conductor group 340 may be disposed along the length of cable structure 300, where first tape 320 may electrically isolate first conductor group 310 from second conductor group 340. As another example, as described with respect to FIGS. 5 and 6, second conductor group 520 may be disposed along the length of cable structure 500, where first tape 530 may electrically isolate first conductor group 510 from second conductor group 520.

It is understood that the steps shown in process 700 of FIG. 7 are merely illustrative and that existing steps may be modified or omitted, additional steps may be added, and the order of certain steps may be altered.

Figure 8:
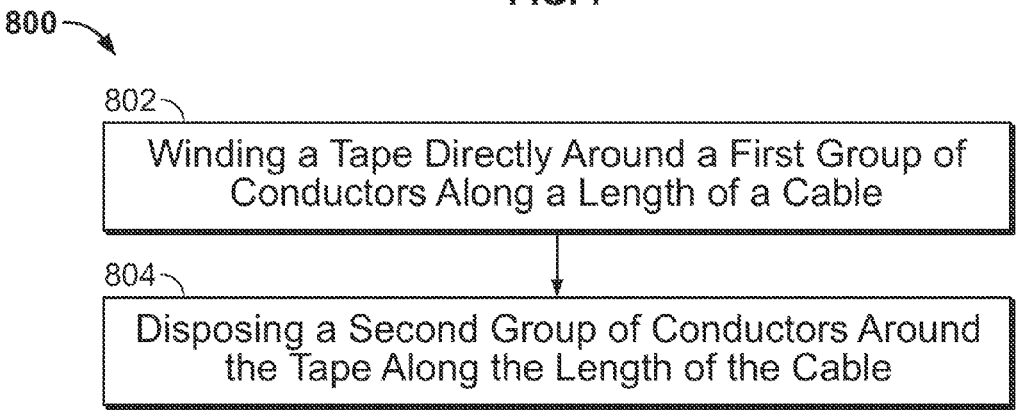

FIG. 8 is a flowchart of an illustrative process 800 for forming a cable. At step 802 of process 800, a first tape may be wound directly around a first group of conductors and along a length of the cable. For example, as described with respect to FIGS. 3 and 4, first tape 320 may be wound directly around first conductor group 310 along a length of cable structure 300. In some embodiments of step 802, a tape may be rotated about a first conductor group as the conductor group is passed between a die and a rotating tip. Then, at step 804 of process 800, a second group of conductors may be disposed around the first tape and along the length of the cable. For example, as also described with respect to FIGS. 3 and 4, second conductor group 340 may be disposed around first tape 320 along the length of cable structure 300. In some embodiments, the first tape of step 802 may electrically isolate the first conductor group from the second conductor group. In some embodiments, process 800 may also include, before step 804, winding a second tape directly around the first tape and along the length of the cable, where the disposing of step 804 may include disposing the second group of conductors directly around the second tape and along the length of the cable.

It is understood that the steps shown in process 800 of FIG. 8 are merely illustrative and that existing steps may be modified or omitted, additional steps may be added, and the order of certain steps may be altered.

Figure 9:
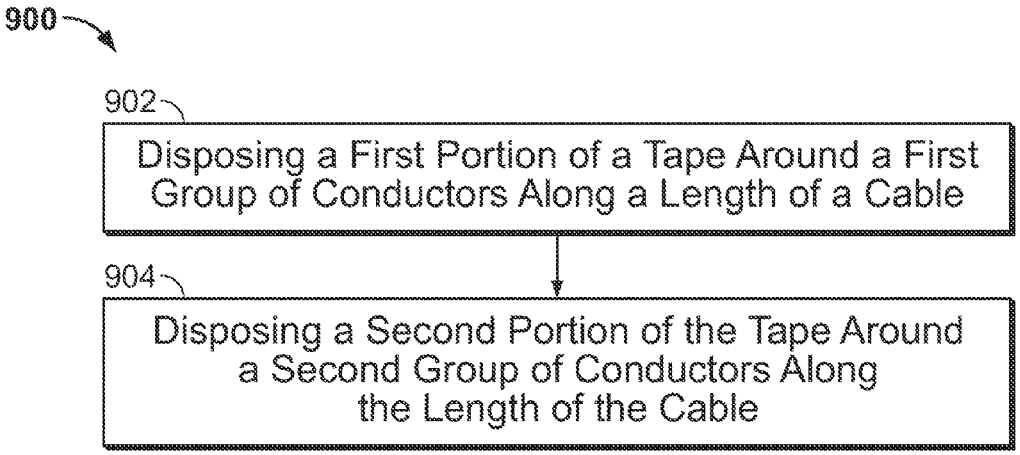

FIG. 9 is a flowchart of an illustrative process 900 for forming a cable. At step 902 of process 900, a first portion of a first tape may be disposed around a first group of conductors and along a length of the cable. For example, as described with respect to FIGS. 5 and 6, a first portion of first tape 530 may be disposed around first conductor group 510 along a length of cable structure 500. Moreover, at step 904 of process 900, a second portion of the first tape may be disposed around a second group of conductors and along the length of the cable. For example, as also described with respect to FIGS. 5 and 6, a second portion of first tape 530 may be disposed around Second conductor group 520 along the length of cable structure 500. In some embodiments, the first tape of steps 902 and 904 may electrically isolate the first conductor group from the second conductor group. In some embodiments, process 900 may also include twisting the first tape, the first group of conductors, and the second group of conductors in a first lay direction, and process 900 may also include winding a second tape in a second lay direction around the first tape and along the length of the cable, where the second lay direction may be the opposite of the first lay direction. For example, as also described with respect to FIGS. 5 and 6, first tape 530, first conductor group 510, and second conductor group 520 may be twisted in a first lay direction S while second tape 540 may be wound about first tape 530 in a second lay direction Z.

It is understood that the steps shown in process 900 of FIG. 9 are merely illustrative and that existing steps may be modified or omitted, additional steps may be added, and the order of certain steps may be altered.

Figure 10:
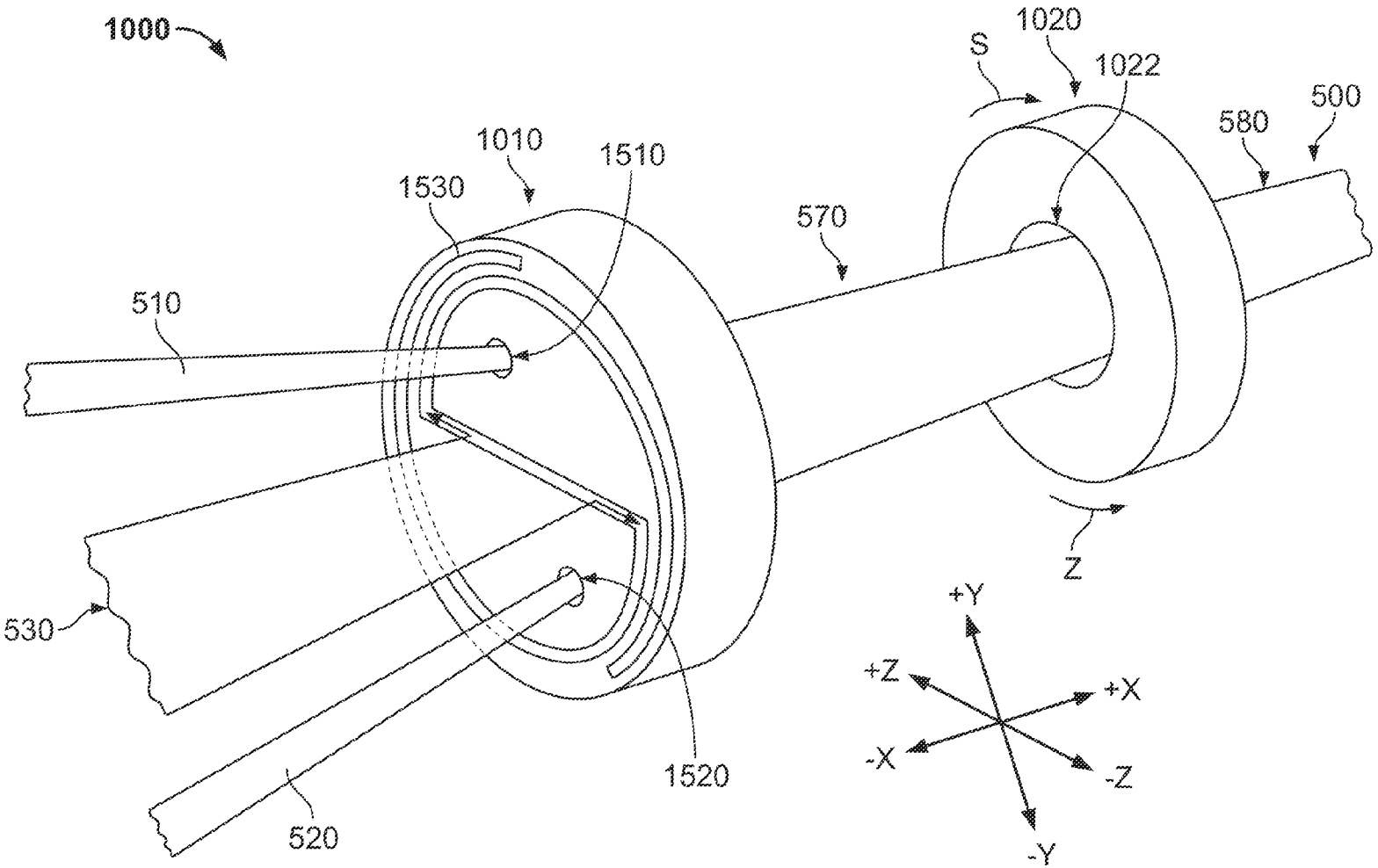
FIG. 10 is a perspective view of an illustrative system that may be used to form at least a portion of a cable structure, in accordance with some embodiments of the invention.

FIG. 10 may show a perspective view of at least a portion of an assembly system 1000 that may be used to form at least a portion of a cable (e.g., cable structure 500 of FIGS. 5 and 6 and/or a cable formed according to process 900 of FIG. 9). As shown, system 1000 may include a fixture 1010 and a tip 1020. Fixture 1010 may include a first passageway 1510 through which first conductor group 510 may be passed (e.g., in the +X-direction), a second passageway 1520 through which second conductor group 520 may be passed (e.g., in the +X-direction), and a third passageway 1530 through which and along which first tape 530 may be passed (e.g., in the +X-direction). Once first conductor group 510, second conductor group 520, and first tape 530 are passed through fixture 1010, they may together (e.g., as collection 570) be received by and passed through a passageway 1022 of tip 1020 (e.g., in the +X-direction). Tip 1020 may rotate (e.g., in the S-direction or the Z-direction), thereby imparting a lay direction on collection 570 and producing twisted collection 580 (e.g., a twisted collection of first conductor group 510, second conductor group 520, and first tape 530). Fixture 1010 may be fixed in space, while tip 1020 may be a fixed distance from fixture 1010 while also being free to rotate in the S-direction or the Z-direction (e.g., about the X-axis) to impart a lay direction onto collection 570 for producing twisted collection 580.

Although not shown, further along the +X-direction, system 100 may be configured to enable second tape 540 to be rotated about twisted collection 580 in either the S-direction or the Z-direction to wind second tape 540 onto cable structure 500. In some embodiments, such winding of second tape 540 onto a first portion of twisted collection 580 may be done concurrently with the rotation of tip 1020 for creating a second portion of twisted collection 580, where such a first portion may be spaced in the +X-direction from such a second portion when both portions are included in a final cable structure 500.

While there have been described cable structures with insulating tape and systems and methods for making the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as up and "down," "front" and "back," "top" and "bottom" and "side," "length" and "width" and "thickness" and "diameter" and "cross-section" and "longitudinal," "X-" and "Y-" and "Z-," and the like are used herein only for convenience, and that no fixed or absolute directional or orientational limitations are intended by the use of these words. For example, the cable structures of this invention can have any desired orientation. If reoriented, different directional or orientational terms may need to be used in their description, but that will not alter their fundamental nature as within the scope and spirit of this invention.

Therefore, those skilled in the art will appreciate that the invention can be practiced by other than the described embodiments, which are presented for purposes of illustration rather than of limitation.

What is claimed is:

1. A cable comprising:

a first plurality of conductors that extends along a length of the cable;

a tape wrapped directly around the first plurality of conductors along the length of the cable; and a second plurality of conductors that extends along the length of the cable, wherein the tape electrically isolates the first plurality of conductors from the second plurality of conductors, wherein:

each conductor of the first plurality of conductors is twisted in a first lay direction with respect to the length of the cable; and the tape is wrapped in a lay direction that is one of the same as the first lay direction and the opposite of the first lay direction.

2. The cable of claim 1, wherein:

the tape comprises a first tape; and the cable further comprises a second tape wrapped directly around the first tape along the length of the cable.

3. The cable of claim 1, wherein:

the tape comprises a first tape; and the cable further comprises a second tape wrapped directly around the first tape along the length of the cable, wherein the second tape is wrapped in a lay direction that is the opposite of the lay direction of the first tape.

4. The cable of claim 1, wherein the tape comprises a polymeric tape with an adhesive on at least a first surface.

5. The cable of claim 1, wherein the second plurality of conductors extends around the tape.

6. The cable of claim 1, wherein a center axis of the first plurality of conductors is the same as a center axis of the second plurality of conductors.

7. The cable of claim 1, wherein the tape is also wrapped directly around the second plurality of conductors.

8. The cable of claim 1, wherein a center axis of the first plurality of conductors is parallel to a center axis of the second plurality of conductors.

9. A cable comprising:

a first plurality of conductors that extends along a length of the cable;

a tape wrapped along a helical path around the first plurality of conductors; and a second plurality of conductors that extends directly around the tape and along the length of the cable, wherein:

a portion of the tape comprises adhesive; and the adhesive directly contacts a portion of at least one conductor of the second plurality of conductors.

10. The cable of claim 9, wherein the tape electrically isolates the first plurality of conductors from the second plurality of conductors.

11. The cable of claim 9, wherein:

the tape comprises a first tape wrapped along a first helical path around the first plurality of conductors;

the tape further comprises a second tape wrapped along a second helical path around the first tape; and the second plurality of conductors extends directly around the second tape.

12. The cable of claim 11, wherein:

the first helical path is in a first lay direction with respect to the length of the cable; and the second helical path is in a second lay direction that is the opposite of the first lay direction.

13. The cable of claim 9, wherein:

each conductor of the first plurality of conductors is twisted in a first lay direction with respect to a longitudinal axis of the length of the cable; and the tape is wrapped in a lay direction that is one of the same as the first lay direction and the opposite of the first lay direction.

14. The cable of claim 9, wherein the second plurality of conductors comprises:

a first layer of conductors that extends around the tape and along the length of the cable; and a second layer of conductors that extends around the first layer of conductors and along the length of the cable.

15. The cable of claim 14, wherein:

each conductor of the first layer of conductors is twisted in a first lay direction with respect to the length of the cable; and each conductor of the second layer of conductors is twisted in a second lay direction that is the opposite of the first lay direction.

16. The cable of claim 9, wherein the tape comprises a polymeric tape with an adhesive on a first surface.

17. The cable of claim 9, wherein a center axis of the first plurality of conductors is the same as a center axis of the second plurality of conductors.

18. A cable comprising:

a first plurality of conductors that extends along a length of the cable;

a second plurality of conductors that extends along the length of the cable; and a tape, wherein:

the tape is disposed directly around the first plurality of conductors along the length of the cable;

the tape is disposed directly around the second plurality of conductors along the length of the cable;

at a cross-section of the cable that is perpendicular to a longitudinal axis of the length of the cable, a first portion of the tape surrounds the first plurality of conductors but not the second plurality of conductors;

at the cross-section, a second portion of the tape surrounds the second plurality of conductors but not the first plurality of conductors;

a third portion of the tape is common to both the first portion of the tape and the second portion of the tape; and the length of the third portion is greater than one third of the diameter of the cable.

19. The cable of claim 18, wherein the tape electrically isolates the first plurality of conductors from the second plurality of conductors.

20. The cable of claim 18, wherein, at the cross-section, a fourth portion of the tape extends from the first portion of the tape and overlaps at least a part of the second portion of the tape.

21. The cable of claim 18, wherein a center axis of the first plurality of conductors is parallel to a center axis of the second plurality of conductors.

22. The cable of claim 1, wherein:

a portion of the tape directly contacts a portion of an outer surface of at least one conductor of the first plurality of conductors; and the portion of the tape comprises adhesive.

* * * * *